US009479873B2

(12) United States Patent
Yamagami et al.

(10) Patent No.: US 9,479,873 B2
(45) Date of Patent: Oct. 25, 2016

(54) SPEAKER APPARATUS

(71) Applicant: Alpine Electronics, Inc., Tokyo (JP)

(72) Inventors: Masaru Yamagami, Fukushima (JP); Arata Tada, Fukushima (JP); Kei Tanabe, Fukushima (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 14/696,083

(22) Filed: Apr. 24, 2015

(65) Prior Publication Data

US 2016/0029127 A1 Jan. 28, 2016

(30) Foreign Application Priority Data

Jul. 24, 2014 (JP) ..... 2014-150617

(51) Int. Cl.

| | |
|---|---|
| ***H04R 1/02*** | (2006.01) |
| ***H04R 7/16*** | (2006.01) |
| ***H04R 9/02*** | (2006.01) |
| *H04R 1/00* | (2006.01) |

(52) U.S. Cl.

CPC *H04R 7/16* (2013.01); *H04R 9/02* (2013.01); *H04R 9/025* (2013.01); *H04R 2209/022* (2013.01); *H04R 2400/11* (2013.01); *H04R 2499/13* (2013.01)

(58) Field of Classification Search

CPC ..... H04R 9/06; H04R 1/023; H04R 1/025; H04R 1/24; H04R 9/02; H04R 9/025; H04R 11/02; H04R 1/00; H04R 1/345; H04R 2201/021; H04R 2201/025; H04R 2400/11; H04R 9/022; H04R 9/04; G10K 11/004

USPC ..... 381/182, 386, 398, 150, 162, 189, 336, 381/396, 397, 404, 407, 433

See application file for complete search history.

(56) References Cited

U.S. PATENT DOCUMENTS

| | | | | |
|---|---|---|---|---|
| 5,475,765 | A | 12/1995 | Lyth | |
| 5,625,701 | A | 4/1997 | Scanlan | |
| 5,778,086 | A * | 7/1998 | Tanabe | H01R 9/16 381/386 |
| 7,085,392 | B1 * | 8/2006 | Garretson | H04R 1/023 381/162 |
| 7,178,628 | B2 * | 2/2007 | Gordon | H04R 1/025 181/150 |
| 2005/0238187 | A1 * | 10/2005 | Baeten | H04R 9/06 381/150 |
| 2011/0135140 | A1 | 6/2011 | Tanabe | |

FOREIGN PATENT DOCUMENTS

| | | |
|---|---|---|
| JP | 1994-276597 | 9/1994 |

OTHER PUBLICATIONS

Extended Search Report for EP 15 17 0084 dated Oct. 23, 2015, 4 pages.

* cited by examiner

*Primary Examiner* — Paul S Kim
*Assistant Examiner* — Norman Yu
(74) *Attorney, Agent, or Firm* — Brinks Gilson & Lione

(57) ABSTRACT

A support chassis mounted on a sounding side of a speaker apparatus is formed of an iron material. The support chassis is formed in a shape in which a central supporting part nears a main-body chassis. A magnetic field generating unit is fixed to the central supporting part on a side of a recess of the support chassis. The support chassis includes a frame part, the central supporting part, and spoke parts. In the spoke part, a width dimension D1 of an inner end part is formed narrower than a width dimension D2 of an outer end part. Therefore, a resistance in a case where a magnetic flux passes through the spoke part increases, and the leaked magnetic field is hardly induced from the magnetic field generating unit to the spoke part. Therefore, a reduction in a speaker output can be prevented.

4 Claims, 4 Drawing Sheets

SPEAKER APPARATUS

RELATED APPLICATIONS

The present application claims priority to Japanese Patent Application Serial Number 2014-150617, filed Jul. 24, 2014, the entirety of which is hereby incorporated by reference.

BACKGROUND OF THE INVENTION

1. Field of the Invention

The present disclosure relates to a speaker apparatus having a support chassis, which supports a magnetic field generating unit, made of a magnetic metal material such as iron. In particular, the present disclosure relates to a speaker apparatus having a structure in which the magnetic field generating unit is fixed to the center on a side of a recess of the support chassis.

2. Description of the Related Art

JP 6-276597 A discloses an invention regarding a speaker apparatus. A speaker frame is provided in the speaker apparatus that has a conical shaped portion, and a conical shaped diaphragm is arranged on a side of a recess. The side of the recess is a sounding side. A magnetic field generating unit in which a magnet is sandwiched between a yoke and a plate is provided, and the magnetic field generating unit is arranged on a side of a projection of the speaker frame and fixed to a bottom plate at the center of the speaker frame. A voice coil wounded around a bobbin fixed to the diaphragm is inserted into a magnetic gap between the yoke and the plate.

Regarding the shape of the speaker frame, a speaker mounting surface on an outer periphery has a ring shape, and frame arms radially extending are integrally formed between the bottom plate to which the magnetic field generating unit is fixed and the speaker mounting surface. Four frame arms are provided, and the width dimension of each frame arm is evenly formed from the bottom plate on a side of the inner periphery to the speaker mounting surface of a side of the outer periphery.

SUMMARY OF THE INVENTION

A speaker frame provided in a speaker apparatus is generally formed of an iron material. The mass of a magnetic field generating unit having the magnet is large, and the speaker frame should have a large rigidity in order to support the magnetic field generating unit. When the rigidity of the speaker frame is small, there is a problem in that an oscillation is easily transmitted from a diaphragm and a Q-value decreases. Specifically, when a speaker apparatus such as a woofer and a sub-woofer has a large diameter, it is necessary to increase the strength of the speaker frame by forming it of a thick iron plate. However, when a speaker magnet is formed of the iron material, a magnetic field leaked from the magnetic field generating unit is attracted into the speaker frame. Also, a magnetic flux density in the magnetic gap where a voice coil is positioned decreases, and accordingly, a problem occurs in that a speaker output decreases.

A path of the leaked magnetic field from the magnetic field generating unit goes from a bottom plate of a center to a frame arm, and then returns from the frame arm to the magnetic field generating unit via a space. Alternatively, the reverse route is followed. Focusing on the speaker frame described in JP 6-276597 A, the frame arm has an even width dimension and has a small transmission resistance relative to the magnetic flux. Therefore, the frame arm has a structure in which the leaked magnetic field from the magnetic field generating unit is easily attracted. However, in the speaker apparatus described in JP 6-276597 A, the magnetic field generating unit is fixed to the bottom plate on the side of the projection of the speaker frame, and each frame arm extends to a direction apart from the magnetic field generating unit towards the outer periphery direction. Therefore, a power to attract the leaked magnetic field by the frame arm is comparatively small.

On the other hand, as a speaker apparatus having a comparatively large diameter such as a woofer and a sub-woofer for vehicle, a so-called counter-drive method apparatus, in which the magnetic field generating unit is fixed to the center on the side of the recess of the iron speaker frame (support chassis), is widely used in order to make the apparatus thin. With this method, as the frame arm of the speaker frame radially extends from the center, the frame arm gets closer to the magnetic field generating unit. Therefore, a space distance between the frame arm and the magnetic field generating unit becomes short, and the leaked magnetic flux to be attracted into the frame arm increases. Then, the effect of the leaked magnetic flux on the speaker output becomes remarkable.

A purpose of the present disclosure is to provide a speaker apparatus which solves the above problems and employs a so-called counter-drive method. Also, speaker apparatuses described in the present disclosure can prevent a speaker output by a leaked magnetic field from decreasing even when a magnetic field generating unit is fixed to a side of a recess of a support chassis formed of a magnetic metal material such as iron material.

A speaker apparatus may include: a main-body chassis; a support chassis defining an outer edge that is fixed to the main-body chassis; a diaphragm positioned between the main-body chassis and the support chassis, the diaphragm defining an outer edge that is fixed to at least one of the main-body chassis and the support chassis; a voice coil fixed to a center of the diaphragm; and a magnetic field generating unit configured to apply a driving magnetic field to the voice coil.

In the speaker apparatus, the support chassis has a projecting shape toward the main-body chassis; the magnetic field generating unit is fixed to a center of a recess side of the support chassis; and the support chassis includes a frame part formed of a magnetic metal material and fixed to the main-body chassis, a central supporting part to which the magnetic field generating unit is fixed, and a plurality of spoke parts for connecting between the frame part and the central supporting part. Each of the spoke parts is formed so that a width dimension D1 of an inner end part positioned in a boundary with the central supporting part is smaller than a width dimension D2 of an outer end part positioned in a boundary with the frame part.

A hole part of the spoke part of the speaker apparatus is opened. It is preferable that an opening width dimension on the side of the outer end part of the hole part be wider than that on the side of the inner end part. In this case, it is preferable that the rib surrounding the hole part is integrally formed in each of the spoke parts.

It is preferable that a ratio of the width dimension D2 of the outer end part relative to the width dimension D1 of the inner end part (D2/D1) of the speaker apparatus be equal to or more than 1.7 and equal to or less than 4.3.

Additionally, it is preferable for the main-body chassis of the speaker apparatus to be formed of a magnetic metal material.

Speaker apparatuses according to the present disclosure may employ counter-drive methods. A magnetic field generating unit having a magnet is fixed to a center on a recess side of a support chassis made of the magnetic metal, and a space distance between a spoke part of the support chassis and the magnetic field generating unit becomes shorter. With this structure, the width dimension of the spoke part is formed to be smaller toward a direction of an inner end part, and a magnetic flux transmission resistance in the spoke part becomes larger. Therefore, a leaked magnetic field is hardly induced from the magnetic field generating unit to the support chassis, and accordingly, a reduction in a speaker output caused by the leaked magnetic field can be prevented.

Also, the magnetic flux transmission resistance in the spoke part can be increased by forming a hole part in the spoke part. In this case, the strength of the spoke part can be secured by forming a rib surrounding the hole part.

DETAILED DESCRIPTION OF THE DRAWINGS

Figure 1:
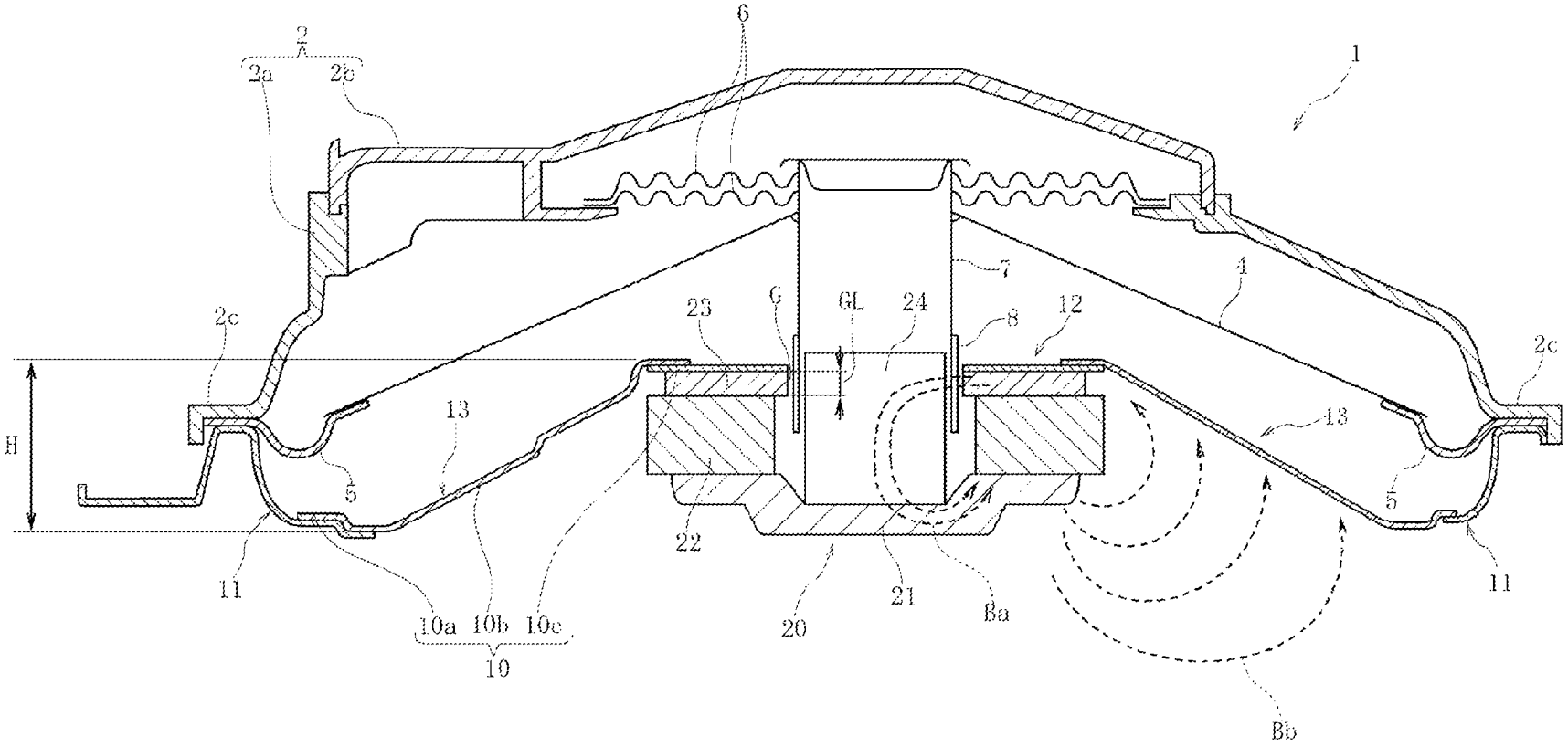
FIG. 1 is a cross-section diagram of a speaker apparatus.

A speaker apparatus 1 illustrated in FIG. 1 employs a so-called counter-drive method. The downward direction in FIG. 1 (V direction) is a sounding direction. The speaker apparatus 1 is used, for example, as a woofer or a sub-woofer for vehicle, and a diameter of the speaker apparatus 1 is about 200 to 350 mm.

A side opposite to a sounding direction (V direction) of the speaker apparatus 1 is covered with a main-body chassis 2. The main-body chassis 2 is formed by joining two members, i.e., an outer peripheral main-body part 2*a* and a central main-body part 2*b*. Both the outer peripheral main-body part 2*a* and the central main-body part 2*b* are formed of an iron material or a magnetic metal material such as an alloy mainly made of iron. The main-body chassis 2 has a case structure in which a recessed side and an opening face to the sounding direction (V direction). The entire main-body chassis 2 may be integrally formed.

A support chassis 10 is fixed to the opening facing to the sounding direction (V direction) of the main-body chassis 2. The support chassis 10 is formed of an outer peripheral member 10*a*, an intermediate member 10*b*, and a central member 10*c* joined to one another. The outer peripheral member 10*a*, the intermediate member 10*b*, and the central member 10*c* are formed of a plate of the magnetic metal material such as iron or alloy including iron, and for example, formed of a rolled steel plate and welded to one another.

Figure 2:
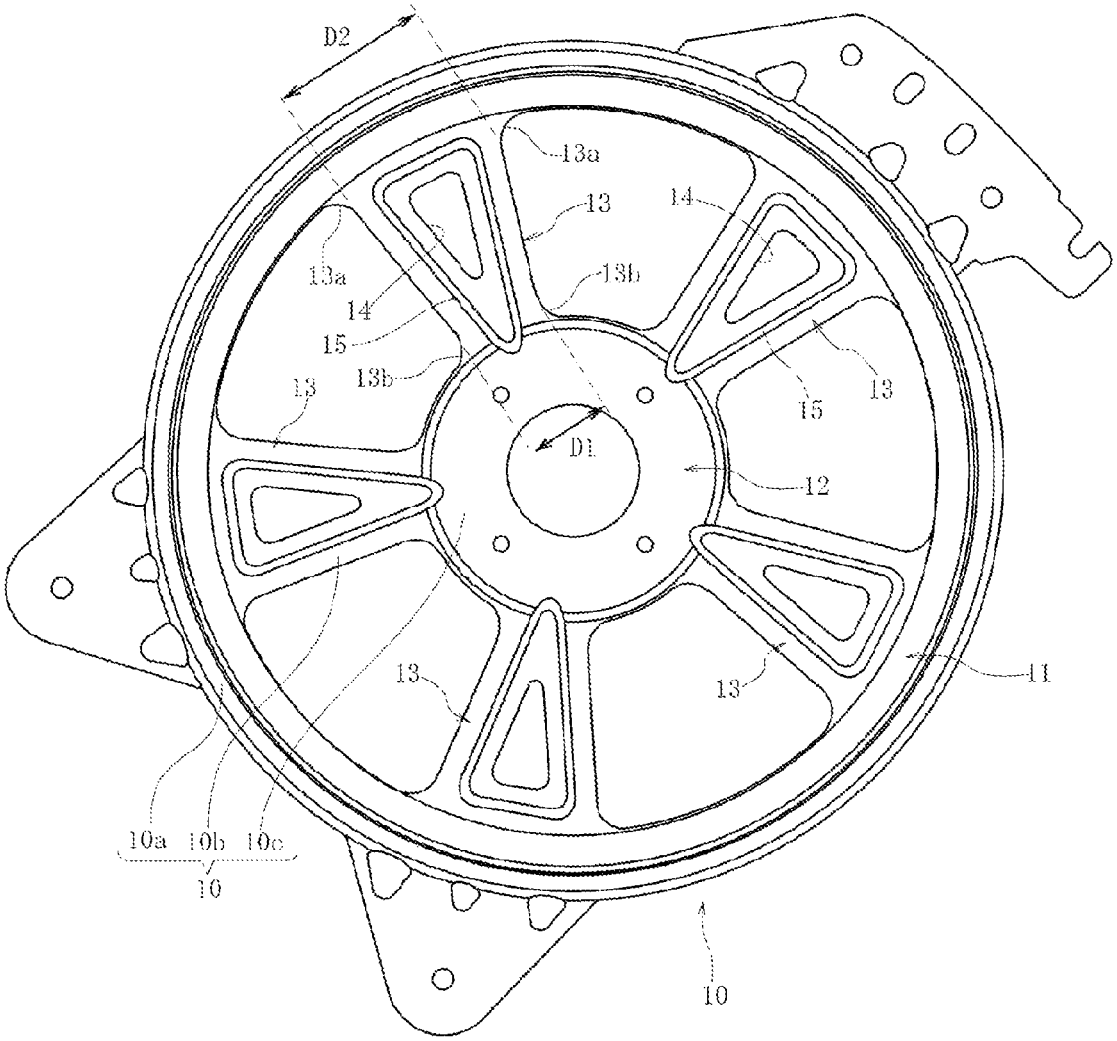
FIG. 2 is a front view of a support chassis of the speaker apparatus illustrated in FIG. 1.

FIG. 2 is a front view of the support chassis 10 viewed from the lower side in FIG. 1. The entire shape of the support chassis 10 includes a ring-shaped frame part 11 positioned on an outer periphery, a circular central supporting part 12 positioned at the center, and a plurality of (five) spoke parts 13 for connecting the frame part 11 with the central supporting part 12 and radially extending. The frame part 11 includes outer peripheral edges of the outer peripheral member 10*a* and the intermediate member 10*b*, and the central supporting part 12 includes inner peripheral edges of the central member 10*c* and the intermediate member 10*b*. The spoke part 13 is formed of the intermediate member 10*b*.

However, the support chassis 10 may be integrally formed of a sheet of the rolled steel plate, and the frame part 11, the spoke part 13, and the central supporting part 12 may be continuously integrally formed.

In the support chassis 10, the intermediate member 10*b*, that is, a part where the spoke part 13 has a conical shape, and the central supporting part 12 has a projecting shape toward the main-body chassis 2 so as to get close to the main-body chassis 2 and has a recessed shape toward the sounding direction (V direction).

In the support chassis 10, an outer edge of the frame part 11 is fixed to an opening edge 2*c* of the main-body chassis 2. The central supporting part 12 is arranged at a position inner than the frame part 11 in the main-body chassis 2, and a magnetic field generating unit 20 is fixed to the central supporting part 12 on the side of the recess of the support chassis 10. The magnetic field generating unit 20 includes a holding yoke 21, a ring-shaped magnet 22 fixed on the holding yoke 21, and a ring-shaped outer periphery yoke 23 fixed on the magnet 22. A central yoke (central pole) 24 is fixed to the center of the holding yoke 21, and a magnetic gap G is formed between an outer peripheral surface of the central yoke 24 and an inner peripheral surface of the outer periphery yoke 23. The thickness dimension of the outer periphery yoke 23 corresponds to the width dimension GL of the vertical dimension of the magnetic gap G.

A diaphragm 4 is provided between the main-body chassis 2 and the support chassis 10. The diaphragm 4 has a conical shape, and a side of a projection is arranged to face to the main-body chassis 2. That is, the projection sides of the centers of the support chassis 10 and the diaphragm 4 face to the same direction. An outer edge of the diaphragm 4 is supported by a first damper member 5. The ring-shaped first damper member 5 has the diaphragm 4 fixed to an inner peripheral part thereof. An outer peripheral part of the first damper member 5 is sandwiched and fixed between the opening edge 2*c* of the main-body chassis 2 and the outer peripheral member 10*a* of the support chassis 10. A bobbin 7 is fixed to an inner peripheral edge of the diaphragm 4, and the bobbin 7 is supported by a second damper member 6. An inner peripheral part of the second damper member 6 is fixed to an outer periphery of the bobbin 7, and an outer peripheral part is fixed to the main-body chassis 2. The diaphragm 4 is supported by the first damper member 5 and the second damper member 6 and can oscillate mainly in the vertical direction in FIG. 1.

A voice coil 8 is wound around the lower part of the bobbin 7, and the voice coil 8 is arranged in the magnetic gap G.

As illustrated in FIG. 2, all the spoke parts 13 have the same shape when being looked from the front. A width dimension D2 of the spoke part 13 of a part where R parts 13*a* on the outer end part are removed becomes the largest, and a width dimension D1 of a part where R parts 13*b* on the inner end part are removed becomes the smallest. Since the width dimension D1 of the spoke part 13 becomes narrower on a side close to the magnetic field generating unit 20, a resistance in the spoke part 13 increases in a case where a magnetic flux passes through the spoke part 13. It is preferable that a ratio of the width dimensions D2/D1 be equal to or more than 1.7 and equal to or less than 2.5. When the ratio is in the preferable range, the width dimension D1 of the spoke part 13 is well balanced against the width dimension D2, and the support chassis 10 can show sufficient strength to support the mass of the magnetic field generating unit 20.

In addition, the resistance in the spoke part 13 in a case where the magnetic flux passes through the spoke part 13 can be increased by reducing the width dimension D1 of the spoke part 13 in the inner end part of the side closer to the magnetic field generating unit 20. Also, a leaked magnetic flux Bb from the magnetic field generating unit 20 is hardly attracted into the spoke part 13.

A hole part 14 is opened in the center of the spoke part 13. An opening width of the hole part 14 is narrower on the inner peripheral side and wider on the outer peripheral side. The resistance in the spoke part 13 in a case where the magnetic flux passes through the spoke part 13 can be increased by forming the hole part 14. In addition, the leaked magnetic flux Bb is hardly attracted into the spoke part 13. Since the width dimension D1 on the inner peripheral side of the spoke part 13 is small and the spoke part 13 has the hole part 14 in the center, it is possible that the strength is slightly reduced. In the support chassis 10 in FIG. 2, ribs 15 surrounding all around the hole part 14 are formed in the spoke parts 13. The rib 15 is formed by raising a part of the spoke part 13 to be project. The rib 15 passes through a place where the width dimension D1 in the spoke part 13 becomes the narrowest and extends to the central supporting part 12. Therefore, the strength of the spoke part 13 can be increased, and the magnetic field generating unit 20 having a large mass can be strongly supported.

Next, an operation of the speaker apparatus 1 will be described.

An upper surface and lower surface of the magnet 22 of the magnetic field generating unit 20 are magnetized to different magnetic poles from each other. A magnetic flux Ba output from the magnet 22 is induced from the facing yoke 23 to the holding yoke 21 via the central yoke 24. The magnetic flux Ba crosses the magnetic gap G between the facing yoke 23 and the central yoke 24. When the opposite sides of the magnet 22 are magnetized to the magnetic pole, a direction of the magnetic flux Ba follows a route opposite to that of FIG. 1. When a voice current is applied to the voice coil 8, the diaphragm 4 is oscillated and sound pressure is given from the diaphragm 4 to the air by an electromagnetic power for acting in the voice current and the magnetic flux Ba. The sound pressure caused by the oscillation of the diaphragm 4 is mainly directed to the sounding direction (V direction).

In FIG. 1, the leaked magnetic flux Bb which does not pass through the magnetic gap G of the magnetic fluxes generated in the magnetic field generating unit 20 is illustrated. In the speaker apparatus 1 of the counter-drive method, since the magnetic field generating unit 20 is fixed to the center of the side of the recess of the support chassis 10, the spoke parts 13 radially extending from the central supporting part 12 get closer to and are opposed to the side of the magnetic field generating unit 20. Therefore, the magnetic flux formed by the magnetic field generating unit 20 is easily attracted into the spoke part 13. Compared with the conventional example described in JP 6-276597 A, the density of the leaked magnetic flux Bb which goes from the magnetic field generating unit 20 to the spoke part 13 via the space (or follows the reverse direction) is easily increased.

However, as illustrated in FIG. 2, in the spoke part 13, the width dimension D1 of the inner end part which is a boundary with the central supporting part 12 is formed narrower relative to the width dimension D2 of the outer end part. Accordingly, a transmission resistance of the magnetic flux is increased when the magnetic flux is about to pass through the spoke part 13 from the outer end part to the inner end part or in an opposite route to this. In addition, the resistance of a case where the magnetic flux passes through the spoke part 13 is increased by providing the hole part 14 in the spoke part 13.

Therefore, even when the spoke part 13 gets close to the side of the magnetic field generating unit 20, the density of the leaked magnetic flux Bb inducted from the magnetic field generating unit 20 to the spoke part 13 can be reduced. The density of the magnetic flux Ba for passing through the magnetic gap G is increased by the same amount as the reduction of the density of the magnetic flux Ba, and the reduction of the sounding output of the speaker can be prevented.

EXAMPLES

Figure 3:
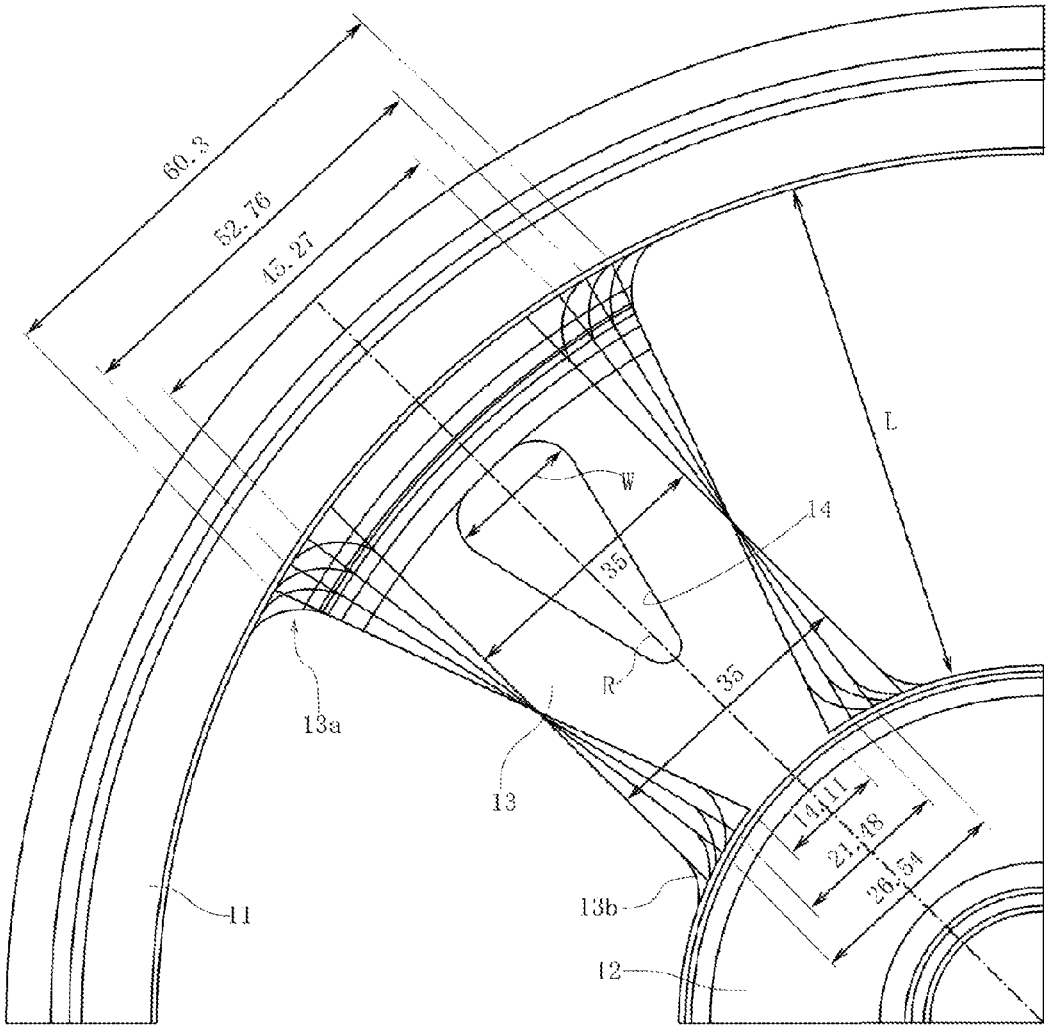
FIG. 3 is an enlarged front view of a part of the support chassis illustrated in FIG. 2.

The support chassis 10 of the speaker apparatus 1 illustrated in FIGS. 1 and 2 is formed of a rolled steel plate having the thickness of 0.3 mm. It is assumed that the length of the spoke part 13 (length including R parts 13*a* and 13*b*) L illustrated in FIG. 3 be 67 mm and that a depth dimension (height dimension) H of the support chassis 10 illustrated in FIG. 1 be 34 mm. It is assumed that an opening length R in a radiation direction of the hole part 14 formed in the spoke part 13 be 33.79 mm and that the maximum width dimension W be 17.42 mm.

As indicated in Table 1 below, in Example 1, it is assumed that the width dimension D1 on the inner peripheral side of the spoke part 13 be 21.48 mm and the width dimension D2 on the outer peripheral side be 52.76 mm. The ratio D2/D1 is 2.5. In Example 2, it is assumed that the width dimension D1 on the inner peripheral side be 14.11 mm and the width dimension D2 on the outer peripheral side be 60.3 mm. The ratio D2/D1 is 4.3. In Example 3, it is assumed that the width dimension D1 on the inner peripheral side be 26.54 mm and the width dimension D2 on the outer peripheral side be 45.27 mm. The ratio D2/D1 is 1.7. In a comparative example, it is assumed that the width dimension D1 on the inner peripheral side and the width dimension D2 on the outer peripheral side be 35 mm. The ratio D2/D1 is 1.

TABLE 1

| | Dimension | | Ratio | |
|---|---|---|---|---|
| | D1 | D2 | D1 | D2 |
| Example 1 | 21.48 | 52.76 | 1 | 2.5 |
| Comparative Example | 35 | 35 | 1 | 1 |
| Example 2 | 14.11 | 60.3 | 1 | 4.3 |
| Example 3 | 26.54 | 45.27 | 1 | 1.7 |

Figure 4:
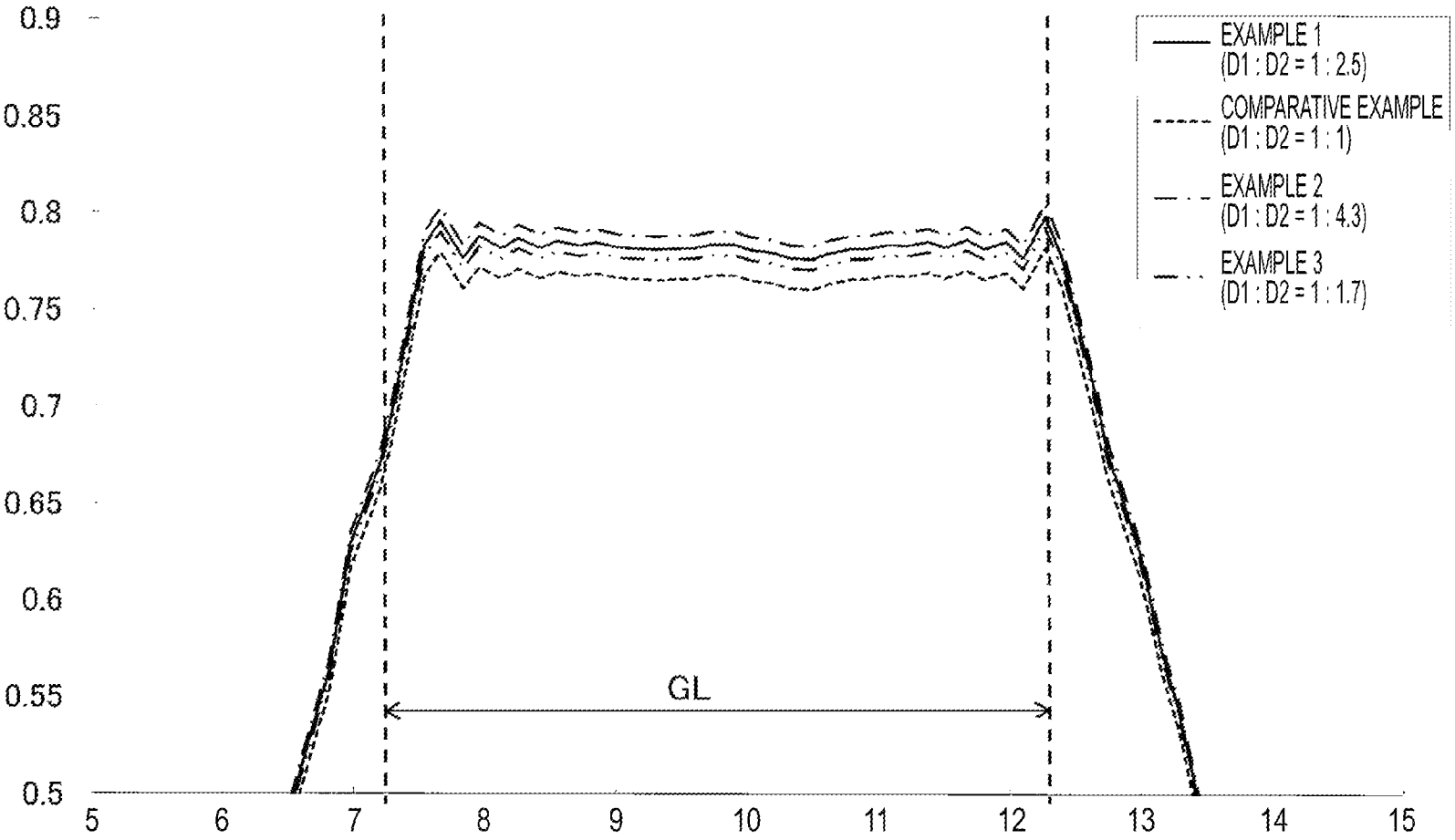
FIG. 4 is a diagram of simulation results in which influences of exemplary leaked magnetic fields and comparative examples are compared.

A simulation result of Examples 1 to 3 and the comparative example is illustrated in FIG. 4. The horizontal axis in FIG. 4 indicates a distance, and GL indicates the width dimension (mm) of the magnetic gap illustrated in FIG. 1. The vertical axis indicates the magnetic flux density (T) in the magnetic gap G.

In the speaker apparatus using the spoke part 13 of which the ratio D2/D1 becomes 1, the magnetic flux density in the magnetic gap G decreases. However, it is found that the magnetic flux density in the magnetic gap is improved in Examples 1 to 3. Therefore, it is found that the reduction of the speaker output can be prevented by satisfying D2>D1. A preferable range of D2/D1 obtained from Examples is equal to or more than 1.7 and equal to or less than 4.3.

It is intended that the foregoing detailed description be regarded as illustrative rather than limiting, and that it be understood that it is the following claims, including all equivalents, that are intended to define the spirit and scope of this invention.

What is claimed is:

1. A speaker apparatus comprising:

a main-body chassis;

a support chassis defining an outer edge that is fixed to the main-body chassis;

a diaphragm positioned between the main-body chassis and the support chassis, the diaphragm defining an outer edge that is fixed to at least one of the main-body chassis and the support chassis;

a voice coil fixed to a center of the diaphragm; and a magnetic field generating unit configured to apply a driving magnetic field to the voice coil, wherein:

the support chassis has a projecting shape toward the main-body chassis, the magnetic field generating unit is fixed to a center of a recess side of the support chassis, the support chassis includes a frame part formed of a magnetic metal material and fixed to the main-body chassis, a central supporting part to which the magnetic field generating unit is fixed, and a plurality of spoke parts for connecting between the frame part and the central supporting part, each of the spoke parts is formed so that a width dimension D1 of an inner end part positioned in a boundary with the central supporting part is smaller than a width dimension D2 of an outer end part positioned in a boundary with the frame part, and a ratio of the width dimension D2 of the outer end part relative to the width dimension D1 of the inner end part (D2/D1) is equal to or more than 1.7 and equal to or less than 4.3.

2. The speaker apparatus according to claim 1, wherein a hole part is opened in each of the spoke parts, and an opening width dimension on a side of the outer end part of the hole part is wider than that of a side of the inner end part.

3. The speaker apparatus according to claim 2, wherein each of the spoke parts has a rib integrally formed therein, and the rib surrounds the hole part.

4. The speaker apparatus according to claim 1, wherein the main-body chassis is also formed of a magnetic metal material.

* * * * *